United States Patent [19]

Lee et al.

[11] Patent Number: 4,752,327

[45] Date of Patent: Jun. 21, 1988

[54] DEPHOSPHORIZATION PROCESS FOR MANGANESE ALLOYS

[75] Inventors: Young E. Lee; Robert H. Kaiser, both of Youngstown, N.Y.

[73] Assignee: Elkem Metals Company, Pittsburgh, Pa.

[21] Appl. No.: 47,640

[22] Filed: May 8, 1987

[51] Int. Cl.[4] ..... C22B 4/00

[52] U.S. Cl. ..... 75/10.15; 75/10.54; 75/53; 75/58

[58] Field of Search ..... 75/53, 58, 10.15, 10.54

[56] References Cited

U.S. PATENT DOCUMENTS 4,364,771 12/1982 Cordier et al. ..... 75/53
4,391,633 7/1983 Yamauchi et al. ..... 75/53
4,450,004 5/1984 Matsuo et al. ..... 75/53
4,684,403 8/1987 Lee et al. ..... 75/80

FOREIGN PATENT DOCUMENTS

85/3963 5/1985 South Africa .

*Primary Examiner*—Peter D. Rosenberg
*Attorney, Agent, or Firm*—Lucas & Just

[57] ABSTRACT

A method for dephosphorizing a manganese alloy by first desiliconizing the alloy to a level below 0.6%, and then dephosphorizing the low silicon alloy with barium carbonate or barium oxide in combination with an oxidizing agent. The lower the silicon content the better the results.

13 Claims, No Drawings

DEPHOSPHORIZATION PROCESS FOR MANGANESE ALLOYS

This invention relates to the removal of impurities from metal and metal alloys and more particularly to a process for removing phosphorus from ferromanganese.

In the production of steel, manganese and ferromanganese are important additives which improve the rolling and forging qualities, strength, toughness, stiffness, wear resistance, hardness and hardenability of steel. Generally, the addition of manganese to steel is accomplished by the addition of a ferromanganese alloy to the melt. Ferromanganese alloys are generally classified by carbon content into three categories. One category, low carbon ferromanganese has a carbon content of less than about 0.75% by weight and a manganese content of about 80 to about 95% by weight. Medium carbon ferromanganese is characterized as having a carbon content between about 0.75 to about 1.5% by weight and a manganese content between about 76 to about 90% by weight. The final major category of ferromanganese is high carbon or standard ferromanganese. This generally has a carbon content of about 2 to about 7% by weight and a manganese content between about 76 to about 82% by weight.

Phosphorus occurs naturally in both manganese and iron ores and is considered to be one of the most harmful impurities in the production of steel. Phosphorus makes steel brittle at high temperature and makes steel susceptible to hot-corrosion cracking and stress-corrosion cracking. Low phosphorus containing ferromanganese alloys are important in the production of high quality steel.

Generally, the American Iron and Steel Institute (AISI) standards for steel call for a phosphorus content of not more than about 0.40% by weight. Both manganese ores and iron ores contain phosphorus in amounts up to about 0.50% by weight.

Generally, ferromanganese alloys are produced by carbothermic reduction of manganese ores in electric or blast furnaces where most of the phosphorus in the ores passes into the smelted ferromanganese alloys. Typically, ferromanganese alloys are produced by heating, melting and reducing manganese ores with a reducing agent such as coke and a slag forming agent in an electric furnace. The phosphorus in a ferromanganese melt is not easily removed.

Calcium and its alloys have been proposed as dephosphorizing agents for ferromanganese alloys under reductive conditions. However, calcium has a great affinity for carbon and will combine more readily with the carbon than with phosphorus, thus the efficiency of its use for removing phosphorus is low for the ferromanganese alloys containing substantial amounts of carbon such as high carbon ferromanganese.

It has suggested by Katayama et al. in South African Patent Application No. 85,3963 that ferromanganese can be produced in a converter type vessel by smelting reduction of manganese containing ores with solid carbonaceous materials. Subsequently, the ferromanganese so produced is dephosphorized under oxidizing conditions using a mixture of barium oxide or barium carbonate and barium chloride under oxidizing conditions.

It has now been discovered that phosphorus can be removed from a manganese alloy produced in an electric or blast furnace by treating a desiliconized manganese alloy melt with a barium oxide containing agent under oxidizing conditions; removing the resulting slag; and recovering a dephosphorized manganese alloy. The desiliconized molten alloy must have a silicon content below about 0.6% by weight and, more preferred, no greater than about 0.2% by weight. Best results have been obtained when the molten alloy has a silicon content of about 0.1% by weight and below.

The term manganese alloy as used in the specification and claims means an alloy containing manganese in an amount of about 60% by weight and above. This definition includes all three categories of ferromanganese as well as manganese itself.

The AISI standard for silicon in high carbon ferromanganese is a maximum of about 1.2% by weight; for medium carbon ferromanganese between about 0.35% to about 1.5%, and for low carbon ferromanganese between about 2.0% to about 7.0% by weight. Turning to the AISI standards for phosphorus, high carbon ferromanganese has the phosphorus content set at a maximum of about 0.35% by weight. For medium carbon ferromanganese the phosphorus content is set at a maximum of about 0.30% while low carbon ferromanganese has a maximum of about 0.30% by weight or below depending on its grade. The silicon content of ferromanganese varies depending on the ore, production methods and conditions. Most carbothermically smelted high carbon ferromanganese has a silicon content in the range of about 0.1% to about 1.2%.

The first step in the present invention is forming a desiliconized manganese alloy melt having a silicon content below about 0.6% by weight, preferably no greater than about 0.2%, with best results being obtained with a molten manganese alloy having a silicon content of about 0.1% by weight and below.

In forming such a melt either a low silicon manganese alloy melt can be formed or the molten manganese alloy can be subjected to a desiliconizing step to bring the content of the silicon to within the specified range of the present invention. The term low silicon manganese alloy means a manganese alloy having a silicon content below about 0.6% by weight, more preferably no greater than about 0.2% by weight, with best results being obtained with the manganese alloy having a silicon content about 0.1% by weight and below. Forming a low silicon manganese alloy melt is obtained either by melting a low silicon manganese alloy or by obtaining a low silicon manganese alloy from an electric or blast furnace smelting operation.

In order to desiliconize the melt in accordance with the present invention, any conventional desiliconizing method can be employed so long as that method drops the silicon content to within the disclosed silicon ranges of the present invention, i.e., below about 0.6% by weight, more preferably no greater than about 0.2% by weight, with best results being obtained when the manganese alloy has a silicon content about 0.1% by weight and below. Preferably, desiliconization is done by adding oxidizing and fluxing agents to the melt. The oxidizing agent can be in the form of gases such as oxygen and carbon dioxide, or in the form of a solid particulate such as oxides of iron and manganese or carbonates of alkaline and alkaline earth metals such as calcium carbonate. The flux provides a fluid slag. Suitable fluxes include oxides and/or halides of alkaline and alkaline earth metals and manganese oxide. Mixtures of solid oxidizing and fluxing agents are preferred to be in the form of granules, powder, or agglomerates. Oxidizing agent can also be gaseous oxygen and/or carbon dioxide. The materials can be added to the melt by any conventional method such as injection or gravity feeding. The preferred method is injection. If the oxidizing and fluxing agents are injected, the carrier gas may be oxygen, carbon dioxide, or any inert gas. A means of good mixing is required such as that provided by a mechanical stirrer, gas bubbling or shaking ladle. When the agents are gravity fed, mechanical stirring, gas bubbling or a shaking ladle is used. When the agents are injected, the carrier gas can provide suitable mixing. The working temperature of the melt should be high enough to provide sufficient heat for the subsequent dephosphorization operation. The temperature is preferred to be in the range of about 1260° to about 1400° C.

When the desired silicon level is obtained, the resulting slag is removed as completely as possible from the melt because any slag left from the desiliconizing step will reduce the thermodynamic activity of the barium oxide containing agent in the subsequent dephosphorization step with the result of reduced efficiency in phosphorus removal. Although the melt at this point containing about 0.1 wt.% silicon and below produces good results under the dephosphorization step of the present invention, phosphorus can be removed from a melt containing silicon in the range from about 0.1 to about 0.6 wt.% by treating with barium oxide containing agents, but the dephosphorization efficiency is poor.

The dephosphorization step is carried out by treating the desiliconized manganese alloy melt with a barium oxide containing agent under oxidizing conditions. A slag will form on the melt during the dephosphorization step. This slag is removed in a conventional manner from the melt prior to recovering the dephosphorized melt. Fluxing agents can be employed along with the barium oxide containing agent. Suitable fluxes include oxides and/or halides of alkaline and alkaline earth metals and manganese oxide. Barium chloride ($BaCl_2$) is also a suitable fluxing agent. However, because barium chloride may reduce the activity of the barium oxide in the melt, its addition should be minimized to less than the amount by weight of the barium oxide in the barium oxide containing agent.

Barium oxide containing agents include barium carbonate and barium oxide. Barium carbonate is preferred. The barium carbonate decomposes in the melt to form barium oxide and carbon dioxide. The carbon dioxide gas released behaves as an oxidizing agent to react with phosphorus, and the barium oxide allows phosphorus to dissolve in the slag. When barium carbonate is not used, additional oxidizing agents are added to the melt along with barium oxide. Such oxidizing agents can be chosen from gases such as oxygen and carbon dioxide and from solid particulate such as oxides of iron and manganese, and carbonates of alkaline and alkaline earth metals such as sodium carbonate. It is preferred that the surface of the melt be covered by the barium oxide containing slag in order to avoid excessive oxidation of manganese. The amount of slag for conventional metallurgical vessel geometries is preferred to be a minimum of about 1.5 times the melt weight. The barium oxide content by weight in the barium containing agent should be a minimum of about 25 times the weight of phosphorus to be removed from the alloy. More preferred is a minimum of about 50 times. The required amount of oxidizing agent when barium oxide itself is used instead of carbonate is arrived at by determining the desired amount of phosphorus to be removed from the alloy, and then determining the amount of oxygen (O) that is stoichiometrically needed to combine with this amount of phosphorus to form $P_2O_5$. This will give the minimum estimated amount of oxidizing agent required in accordance with the present invention. It is preferred to use at least about 2.5 times the minimum amount of oxygen needed to drop the phosphorus content to the desired level.

The oxidizing agents are preferred to be in the form of granules or powder except for oxygen, carbon dioxide, and other gaseous oxidants which are preferably gaseous. The preferred oxidizing agents are oxygen gas and carbon dioxide gas which can also be used to inject the barium oxide containing agent into the melt. The solid agent can be added to the melt by any conventional methods such as injection or gravity feeding. The preferred method is injection. If injection is employed, the carrier gas can be oxygen, carbon dioxide, or any inert gas. If added by gravity, a means of good mixing is required such as that provided by mechanical stirring, gas bubbling, or a shaking ladle. The treating temperature is preferred to be in the range of 1260° to 1400° C.

Further details and advantages of the present invention will readily be understood by reference to the following examples:

EXAMPLE 1

This example compares dephosphorization of two high carbon ferromanganese alloys with different silicon contents. Both alloys are dephosphorized in accordance with the present invention. Two ferromanganese melts were prepared, one having a silicon content of 0.66% and the other having a silicon content of 0.27%. The makeup of each melt as well as the results from the dephosphorization step are given in Table I below.

TABLE I

| Melt | | Alloy % wt. | | | % wt. Phosphorus | |
|---|---|---|---|---|---|---|
| No. | Amount Alloy (kg) | Mn | C | Si | Before | After |
| 1 | 2.7 | 78 | 7 | 0.66 | 0.31 | 0.31 |
| 2 | 3.0 | 78 | 7 | 0.27 | 0.32 | 0.19 |

The percents of manganese, carbon and silicon are given for the before-treatment alloy and have been rounded off for convenience.

The alloys were placed into separate graphite crucibles and melted in a 50 kW induction furnace. After melting the temperature was maintained at about 1300° C. for both melts. To each melt was then added barium carbonate, 165 grams of Melt 1 and 300 grams for Melt 2. During the addition of the barium oxide containing agents to the melts, each was stirred with a rotating graphite impeller. Melt 2 was made using electrolytic manganese, steel scrap, ferrophosphorus and thermatomic carbon. Melt 2 was made to simulate a desiliconized manganese alloy by making up the melt to have a low silicon content. A layer of slag covered both melts during the dephosphorizing step. This layer formed after the barium oxide containing agents were added to the crucible. Stirring in both melts lasted about 20 minutes. Then the melt was solidified. Once the melt was solidified, the solid phosphorus containing slag was removed from the top of the solid alloy and the alloy was then analyzed.

It is clearly evident from this example that the treatment of a desiliconized manganese alloy melt with a barium oxide containing agent under oxidizing conditions drastically reduces the phosphorous content of the alloy while treatment of the manganese alloy melt containing not below about 0.6% silicon with the barium oxide containing agent had no effect.

EXAMPLE 2

This example illustrates preparing five high carbon ferromanganese melts and performing a desiliconizing operation followed by a dephosphorizing step on each of the melts in accordance with the present invention. Table II below compiles the results from this example. The procedures employed are discussed following Table II.

TABLE II

| Melt No. | 1 | 2 | 3 | 4 | 5 |
|---|---|---|---|---|---|
| Amount Alloy (kg) | 3.2 | 3.2 | 3.2 | 3.2 | 4.0 |
| Desiliconizing Agent (g) | | | | | |
| $CaCO_3$ | 160 | 200 | 320 | 200 | 206 |
| $CaF_2$ | 40 | 50 | 80 | 50 | 169 |
| $Mn_3O_4$ | — | — | — | 200 | — |
| Dephosphorizing Agent (g) | | | | | |
| $BaCO_3$ | 135 | 185 | 200 | 200 | 400 |
| $BaCl_2$ | 65 | 15 | — | — | — |
| Metal Analysis (% by wt.) | | | | | |
| Initial | | | | | |
| Phosphorus | 0.20 | 0.22 | 0.20 | 0.22 | 0.19 |
| Silicon | 0.67 | 0.73 | 1.11 | 0.87 | 1.07 |
| After Desiliconization | | | | | |
| Phosphorus | 0.20 | 0.22 | 0.19 | 0.21 | 0.21 |
| Silicon | 0.22 | 0.30 | 0.33 | 0.095 | 0.069 |
| After Dephosphorization | | | | | |
| Phosphorus | 0.17 | 0.18 | 0.14 | 0.13 | 0.11 |
| Silicon | 0.11 | 0.063 | 0.091 | 0.080 | 0.075 |

High carbon ferromanganese alloys having a typical chemical analysis of 79.5% by weight manganese, 6.5% by weight carbon, 12.5% by weight iron and a phosphorus and silicon content as shown in Table II above were melted in a graphite crucible.

DESILICONIZING

The fluxing and oxidizing agents used to desiliconize the melt were added in an amount as shown. Each was in a powdered form. An impeller was used to mix these agents with the melt. The melt was maintained at 1300° C. during the desiliconizing step. After mixing for about 15 to 20 minutes, the slag was removed from the surface of the melt in a conventional manner.

DEPHOSPHORIZING

Next, the barium oxide containing agent was added. In some cases a fluxing agent was added to the melt. The melt was mixed during the dephosphorization step with an impeller for about 15 to 20 minutes. The melt was maintained at 1300° C. during the dephosphorization step.

In this manner the process of the present invention was accomplished. The dephosphorized melts were then solidified and the solid phosphorus containing slag was removed from the top of the solid alloy. The alloy was next subjected to a chemical analysis to determine its final silicon and phosphorus content.

It will be understood that the claims are intended to cover all changes and modifications of the preferred embodiment of the present invention herein chosen for the purpose of illustration which do not constitute a departure from the spirit and scope of the invention.

What is claimed is:

1. A method for dephosphorizing a manganese alloy formed in an electric or blast furnace comprising:

(a) forming a desiliconized manganese alloy melt having a silicon content below about 0.6% by weight and a manganese content of greater than or equal to about 60% by weight; and (b) treating said melt with a barium oxide containing agent under oxidizing conditions to dephosphorize said melt.

2. The method of claim 1 wherein the step of forming a desiliconized manganese alloy melt having a silicon content below about 0.6% by weight is accomplished by melting a low silicon manganese alloy.

3. The method of claim 1 wherein the step of forming a desiliconized manganese alloy melt having a silicon content below about 0.6% by weight is accomplished by the step of obtaining an electric or blast furnace smelted low silicon manganese alloy.

4. The method of claim 1 wherein the step of forming a desiliconized manganese alloy melt having a silicon content below about 0.6% by weight is accomplished by the step of desiliconizing a melt of manganese alloy to a silicon content below about 0.6% by weight.

5. The method of claim 1 wherein the silicon content of the alloy is about 0.10% by weight and below.

6. The method of claim 4 wherein the desiliconizing step is accomplished by adding oxidizing agents and fluxing agents to the melt and removing the resulting slag.

7. The method of claim 6 wherein the barium oxide containing agent is barium carbonate.

8. The method of claim 6 wherein the treatment step is accomplished by adding a mixture of barium carbonate and barium chloride to the melt.

9. The method of claim 6 wherein the barium oxide containing agent is barium oxide in combination with an oxidizing agent.

10. A method for dephosphorizing a manganese alloy comprising:

(a) treating a manganese alloy melt having a manganese content of greater than or equal to about 60% by weight with oxidizing agents and fluxing agents to drop the silicon level of said alloy to below about 0.6%; and (b) treating said melt with a barium oxide containing agent under oxidizing conditions.

11. The method of claim 10 wherein said barium oxide containing agent is barium carbonate or barium oxide in combination with an oxidizing agent.

12. The method of claim 11 wherein the oxidizing agent used in combination with barium oxide is selected from the group consisting of oxygen, carbon dioxide, iron oxides, manganese oxides, alkali metal carbonates, and alkaline earth metal carbonates.

13. The method of claim 11 wherein additional fluxing agents are added during the treatment of the melt with the barium oxide containing agent.

* * * * *